US005983697A

United States Patent [19]

West

[11] Patent Number: 5,983,697

[45] Date of Patent: Nov. 16, 1999

[54] CLIP PLIERS

[76] Inventor: Robert J. West, 752 Hallowell Rd., Pownal, Me. 04069

[21] Appl. No.: 09/183,609

[22] Filed: Oct. 30, 1998

[51] Int. Cl.[6] ..... B21D 7/06; B21F 45/16

[52] U.S. Cl. ..... 72/409.03; 29/243.56; 140/93 D

[58] Field of Search ..... 72/409.03, 409.02, 72/409.04; 29/243.56; 140/93 D, 106; 227/48, 120

[56] References Cited

U.S. PATENT DOCUMENTS

| | | | |
|---|---|---|---|
| 130,853 | 8/1872 | Hill | 72/409.02 |
| 689,721 | 12/1901 | Holland | 72/409.03 |
| 2,174,152 | 9/1939 | Curtiss | 72/409.03 |
| 2,208,819 | 7/1940 | Smith | 140/93 D |
| 2,555,903 | 6/1951 | Schroeder | 72/409.03 |
| 2,756,427 | 7/1956 | Van Zante | 72/409.03 |
| 3,945,238 | 3/1976 | Eckert | 29/243.56 |
| 4,313,333 | 2/1982 | Malagnoux | 29/243.56 |
| 4,787,236 | 11/1988 | West | 72/409.03 |
| 4,845,973 | 7/1989 | West | 72/409.03 |

FOREIGN PATENT DOCUMENTS

| | | | |
|---|---|---|---|
| 2231480 | 12/1974 | France | 29/243.56 |

*Primary Examiner*—Daniel C. Crane
*Attorney, Agent, or Firm*—William Nitkin

[57] ABSTRACT

A hog-ring type clip-applying device having an upper jaw and a lower jaw with a clip receipt area defined therebetween to receive and clench a hog ring clip. The lower jaw is attached to a rear handle, and the upper jaw is attached to a diagonally disposed lever bar which is pivotally attached near its top to the lower jaw. The lever bar is pivotally attached at its bottom to a front handle member which has a guide opening disposed at the top thereof to receive therethrough the upper and lower jaws. A spring member urges the front handle member apart from the rear handle. A clip slide directs clips forward into the clip receipt area between the upper and lower jaws such that when the front and rear handles are moved together, the jaws grasp a clip from the forwardmost end of the clip slide and move forward through the guide opening in the top of the front handle to a position such that when the front and rear handles are further moved together, they clench the clip.

5 Claims, 6 Drawing Sheets

CLIP PLIERS

BACKGROUND OF THE INVENTION

1. Field of the Invention

The device of this invention resides in the art of pliers for applying clips and more particularly relates to a hand-operated clip applier which uses closing jaws to apply hog ring clips.

2. Description of the Prior Art

There are many well known clip appliers in the prior art relating to hog ring type clips. Pliers of the type based on the principle of closing jaws are disclosed early in the prior art. For example in U.S. Pat. No. 130,853 of 1872 to H. W. Hill entitled Improvements in Instruments for Ringing Hogs, the hog ring clips are shown applied by pliers having a jaw with slots formed therein to hold the rings. Many other jaw-type clip appliers have been developed over the years. Such prior art includes a variety of manually and pneumatically operated clip pliers for clenching hog ring type clips with jaw members which close around the clip to clench the clip around the desired object(s).

The present inventor has received patents in this field, the most relevant being U.S. Pat. No. 4,845,973. The clip pliers of that invention rely on intricately-shaped upper and lower jaws that are difficult to machine and may require adjustment during the life of the device.

SUMMARY OF THE INVENTION

It is an object of this invention to provide clip pliers with an improved clenching system having a simpler jaw mechanism that is easy to manufacture. The clenching system includes a clip guide attached to the front handle which clip guide has an angled guide portion which aligns a clip from the feed system in the space between the upper and lower jaws. Because of this improved clip guide and clenching system, much of the structure of prior art upper and lower jaw members has been eliminated. The resulting jaws' sides are machined flat, saving considerable time and expense in their manufacture.

It is a further object of this invention to provide improved pliers having increased distance between the upper and lower jaw members. Because of such increased distance, the jaw members never contact each other near their jaw portions when clenched around a hog ring. This feature overcomes a problem in the prior art where adjustment would be required if such contact restricted the pliers' ability to completely close a clip. No such adjustment is required in the present invention, as the jaw members do not contact one another at their forward jaw portions.

It is a further object of this invention to provide clip pliers having a simpler handle spring mechanism. In West U.S. Pat. No. 4,845,973 clenching was accomplished using two separate springs wound around a pivot member in the front handle with a third leaf spring located within the front handle. The present invention reduces the number of springs from three to one, providing for a single spring with a coil disposed above a pivot member and with portions of the spring extending to both handles, the single spring accomplishing the same task as the previously used three springs.

It is yet a further object of this invention to provide an improved feed system which directs clips to the area between the jaws at an angle and a metal extension spring housed adjacent the clip slide, such metal extension spring helping to provide for a more consistent feeding of the clips, no matter how many are lined up along the clip slide.

DESCRIPTION OF THE PREFERRED EMBODIMENT(S)

Figure 1:
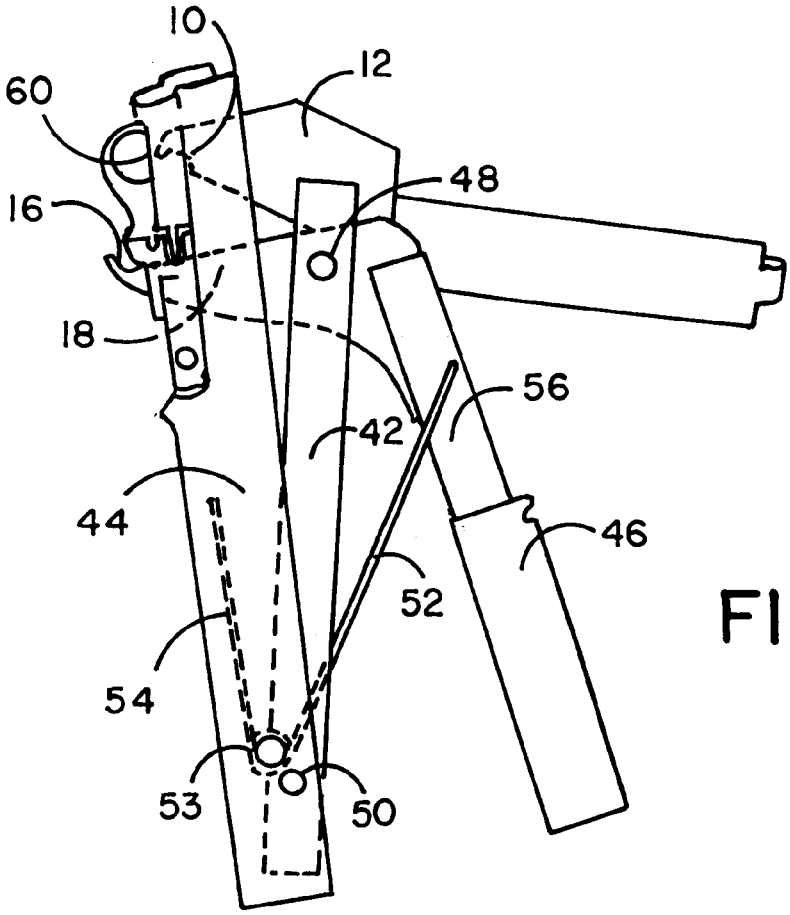
FIG. 1 illustrates a left side view of the clip pliers of this invention with portions of the feed system omitted.
Figure 2:
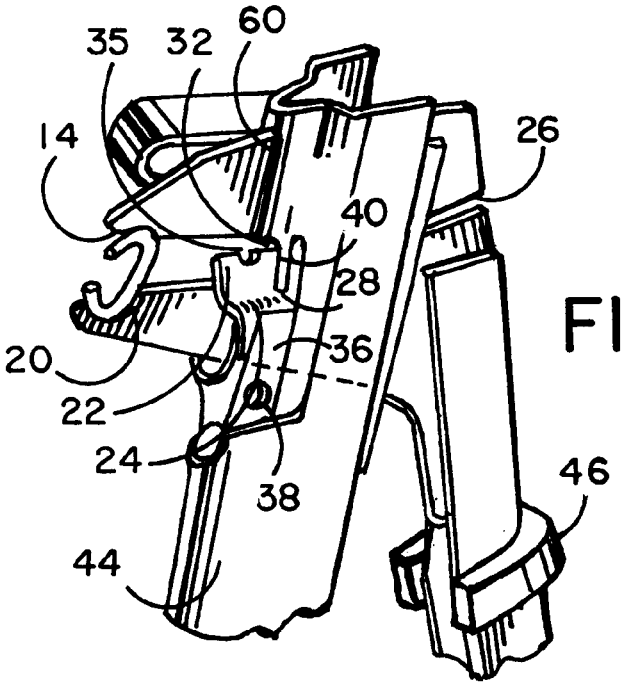
FIG. 2 illustrates an enlarged left side perspective view of the jaws of this invention with portions of the feed system omitted.

FIG. 1 illustrates a left side view of the clip pliers of this invention showing upper jaw 10 and lower jaw 16 with the clip feed system only partially seen. At the front end of upper jaw member 12 is upper jaw 10 and lower jaw 16 is located at the front of lower jaw member 18. Each jaw member 12 and 18 extends rearward from jaws 10 and 16, respectively. Upper jaw member 12 extends to its end, such upper jaw member 12 being attached to lever bar 42, such as by welding, which lever bar extends downward substantially perpendicular thereto. Lower jaw member 18 continues rearward beyond lever bar 42, as seen in FIG. 1, and then extends downward at an angle of approximately 100 degrees as rear handle 46 at substantially the point at which upper jaw member 12 terminates. The rear ends of upper jaw member 12 and lower jaw member 18 are in substantial alignment while the front portions are spaced apart from one another a distance such that even when clenched around a clip, they do not contact one another. The lack of contact better allows the clenching of each clip. In this way each clip will be fully clenched as the lower surface 102 and upper surface 100 can not contact one another as the clip is clenched. Upper jaw member 12 and its attached lever bar 42 are pivotally attached at first pivot 48 to lower jaw member 18 and rear handle 46 so that if one moves rear handle 46 back and forth in relation to lever bar 42, upper jaw 10 and lower jaw 16 open and close together. Lever bar 42 can be formed by two parallel members extending on either side of lower jaw member 18. Front handle member 44 is provided which is attached at its bottom by second pivot 50 to the lower portion of lever bar 42. At the top of front handle member 44 is defined guide opening 60, as shown in FIG. 2, through which lower jaw 16 and lower jaw member 18 pass.

Figure 3:
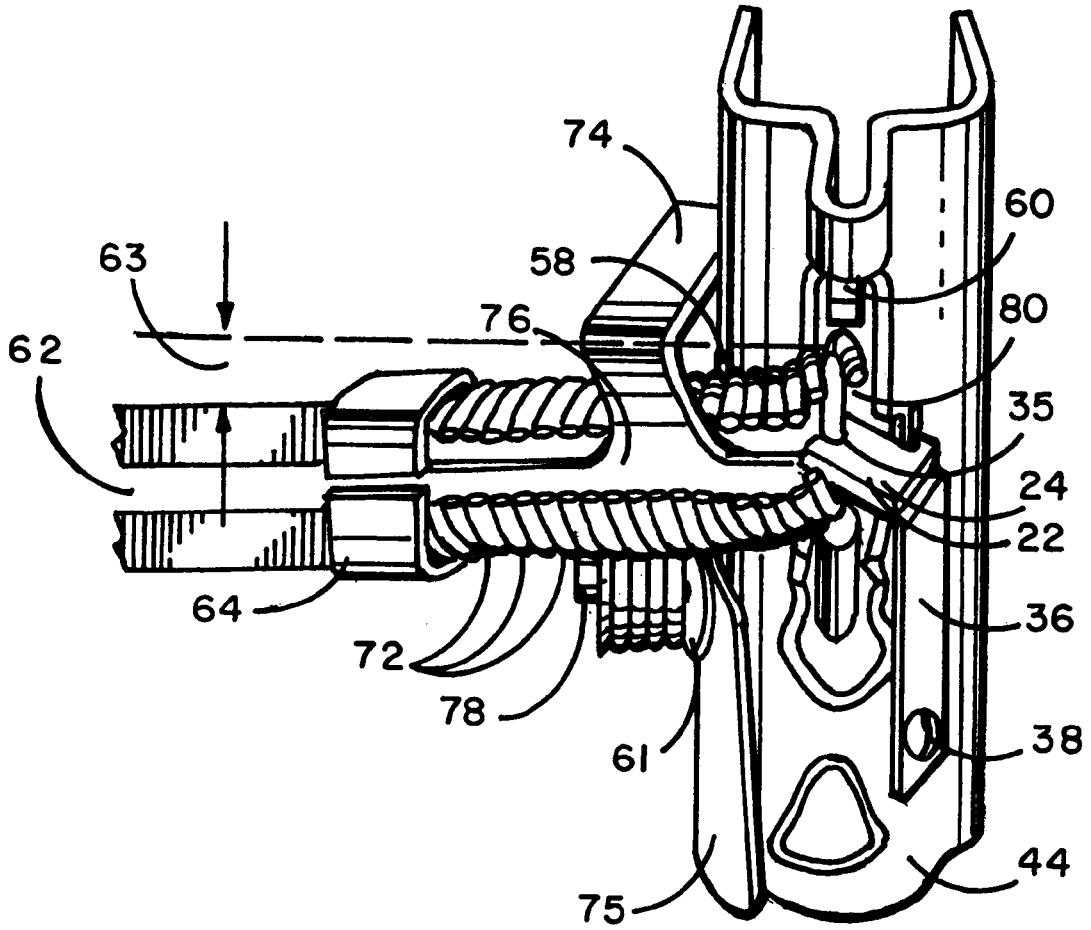
FIG. 3 illustrates an enlarged front view of the clip receipt area of the clip pliers with a clip in place.
Figure 4:
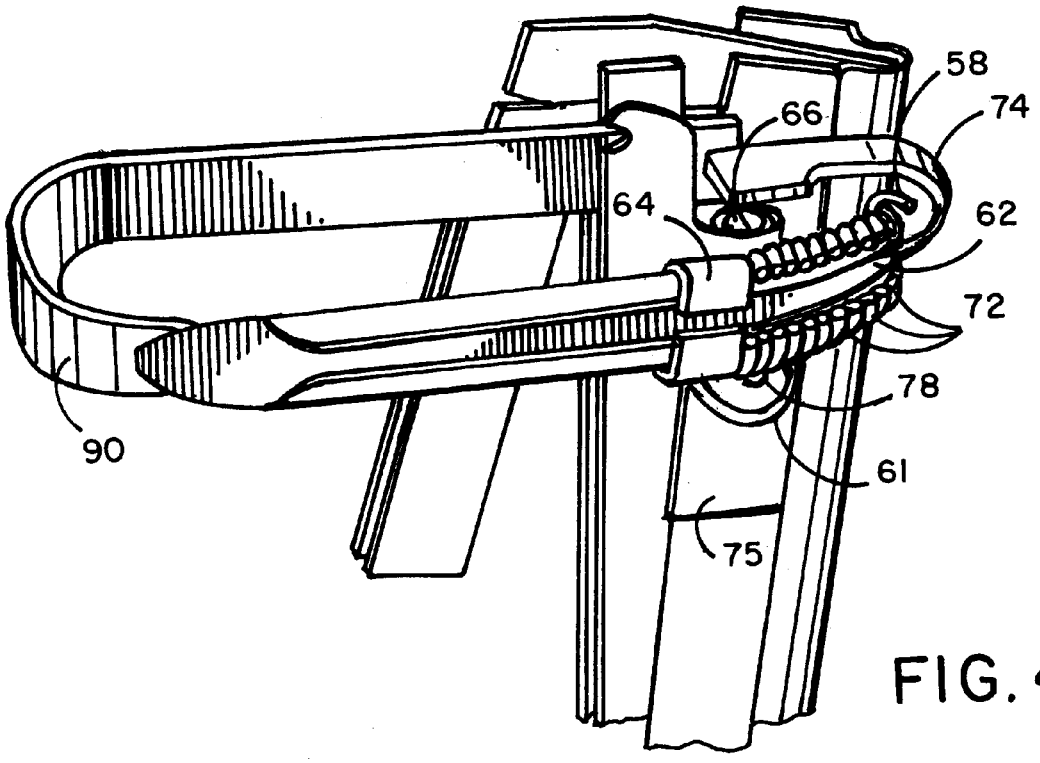
FIG. 4 illustrates an enlarged right side perspective view of the clip feed system of the clip pliers.

FIG. 3 illustrates an enlarged front view of the clip receipt area of the clip pliers. As seen in FIG. 3, on the second side of front handle member 44 is clip slide attachment member 74 which extends at an upward angle and then around to the front where it is attached, such as by welding, to clip slide 62. Clip slide attachment member 74 is attached to clip slide 62 at the front portion 76 thereof so that when a clip 72 is moving along clip slide 62, which extends first outward from clip slide attachment member 74 and then extends toward the rear of the device, the forward facing open portions of each clip 72 will pass behind front portion 76 of clip slide attachment member 74 while moving on clip slide 62. Clip slide attachment member 74 holds clip slide 62 at approximately a 3-degree angle 63 to front handle 44 to best align the clips between the jaws. A pusher member 64, as seen in FIGS. 3 and 4, which slides along clip slide 62 at the rear of a series of clips 72, is pulled along clip slide 62 by metal extension spring 66, best seen in FIG. 8, which urges clips 72 in front of pusher member 64 always to progress along clip slide 62 through clip receipt opening 58 defined in the second side of front handle member 44 to clip receipt area 80 defined between upper and lower jaws 10 and 16, as seen in FIGS. 2, 3 and 4.

Figure 7:
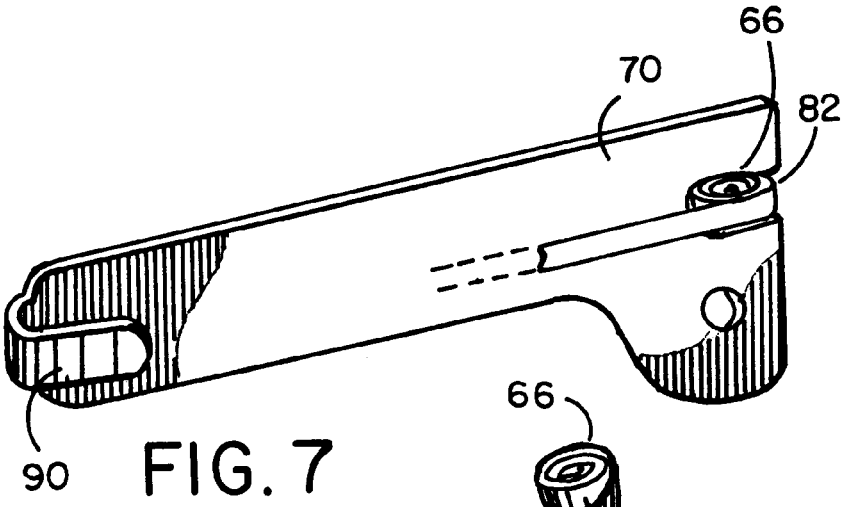
FIG. 7 illustrates a right side perspective view of the spring housing support member.

FIG. 7 illustrates spring housing support member 70 separated from the device with a portion of extension spring 66 shown coiled in spring receipt slot 82. Spring housing support member 70 curves around at its end 90 which urges against the end of clip slide 62 as seen in FIG. 4.

Figure 8:
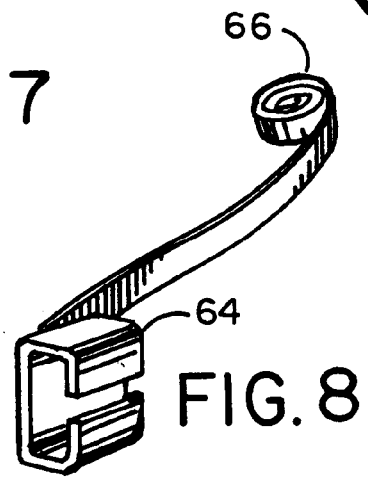
FIG. 8 illustrates a right side perspective view of the extension spring and pusher member.
Figure 9:
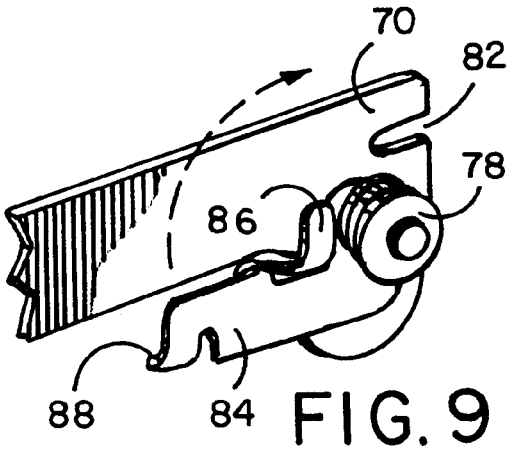
FIG. 9 illustrates a right side perspective view of the end of the spring housing support member and the spring cover.
Figure 10:
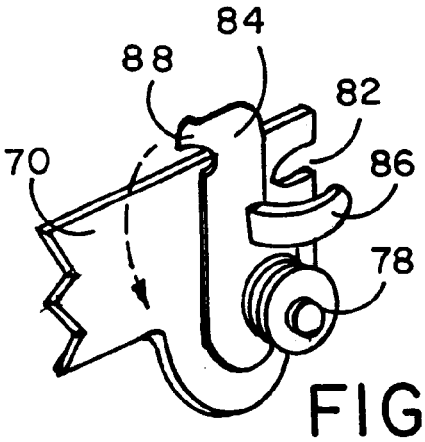
FIG. 10 illustrates the embodiment shown in FIG. 9 with the spring cover rotated into its position to retain a spring member which is not shown in this view.

FIG. 8 shows the complete extension spring 66 with pusher member 64 attached. By manually rotating spring cover 84 to its open mode, as seen in FIG. 9, from its closed position, as seen in FIG. 10, one can gain access to extension spring 66 in spring receipt slot 82 as spring retainer 86 no longer holds extension spring 66 in place. In this fashion extension spring 66 can be easily replaced if it should break. FIG. 4 illustrates the attachment of extension spring 66 to the clip pliers device. Spring retainer 86 contains extension spring 66 which spring 66 winds up on itself therein as successive clips advance along clip slide 62. Spring retainer 86 is formed from a portion of spring cover 84 which rotates on spring-loaded bolt 78 over spring housing support member 70. Spring housing support member 70 extends around in an arc toward clip slide 62, terminating at end 90 soon after reaching clip slide 62. As seen in FIGS. 3, 4, 9 and 10, spring housing support member 70 has a plate portion 61 extending downward, such plate portion 61 being fastened to the clip pliers device in conjunction with the downwardly extending rear portion 75 of clip slide attachment member 74, all three parts being held onto the device by spring-loaded bolt 78. When spring cover 84 is rotated to its upright, closed mode to retain extension spring 66 behind spring retainer 86 in spring receipt slot 82, catch member 88 at the top of spring cover 84 catches on the top of spring housing support member 70 to help hold spring cover 84 in place in its upright closed mode. When it is desired to replace extension spring 66, catch member 88 is manually moved off the top of spring cover 84 and spring cover 84 can be rotated to its open mode.

Figure 2A:
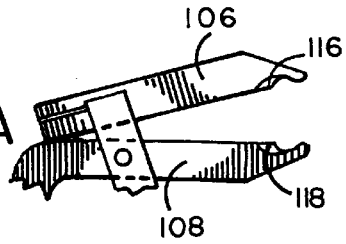
FIG.2A PRIOR ART
FIG. 2A illustrates a right side view of a prior art clip pliers showing the upper and lower jaws open to receive a clip.
Figure 2B:
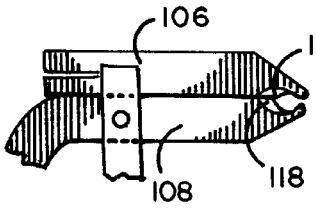
FIG.2B PRIOR ART
FIG. 2B illustrates the prior art clip pliers of FIG. 2A with its jaws in a closed position.
Figure 2C:
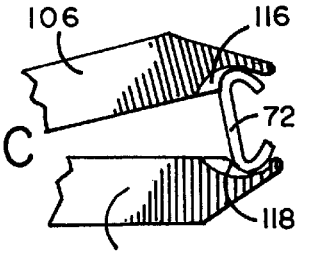
FIG.2C PRIOR ART
FIG. 2C illustrates an enlarged right side view of the jaw ends of the clip pliers of FIG. 2A with such jaws open with a clip therein.
Figure 2D:
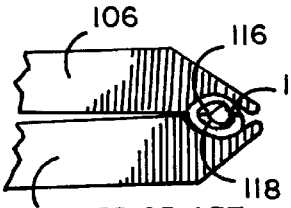
FIG.2D PRIOR ART
FIG. 2D illustrates an enlarged right side view of the jaw ends of FIG. 2C with such jaws closed, clenching a clip.
Figure 2E:
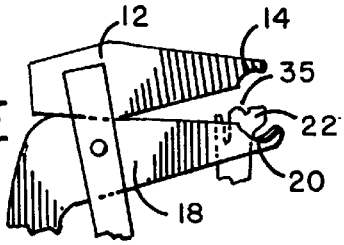
FIG. 2E illustrates a right side view of the clip plier jaws in their open mode.
Figure 2F:
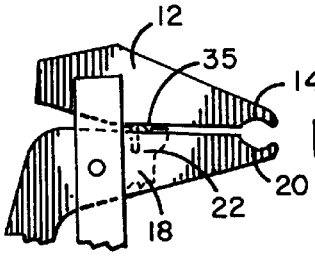
FIG. 2F illustrates a right side view of the clip plier jaws in their closed mode.
Figure 2G:
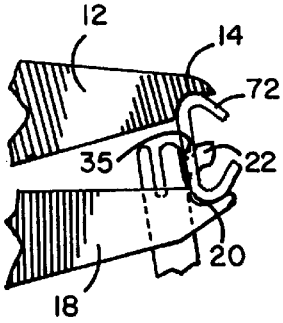
FIG. 2G illustrates an enlarged right side view of the jaw ends of the clip pliers of FIG. 2E with a clip in place.
Figure 2H:
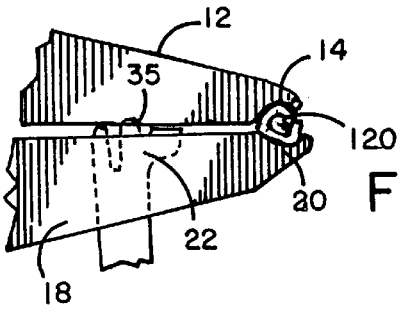
FIG. 2H illustrates an enlarged right side view of the jaw ends of the clip pliers of FIG. 2G with the jaws clenched around a clip.

As best seen in FIGS. 2 and 3, clip guide 22 is attached to the first side of front handle member 44 held in place by pressure from clip guide spring 36 which is held by screw 38. It is the unique structure of clip guide 22 and its clip slot 35 along with the entry of the clips at a 3-degree angle to clip receipt area 80 which ensures the proper grasping of clips 72 off the end of clip slide 62 as such clip's alignment in clip receipt area 80 is critical to the jaws consistently grasping of the clips, as shown in FIGS. 2 and 3. Clip guide 22 is attached onto front handle member 44 at a slanted position which is disposed toward the jaws at approximately a 125 degree angle, forming slanted portion 24, as best seen in FIG. 3. Slanted portion 24 of clip guide 22 is urged inward by clip guide spring 36 toward clip receipt area 80. As shown in FIG. 3, clip 72 in clip receipt area 80 is positioned between upper and lower jaws 10 and 16. Upper and lower jaws 10 and 16 are flat on their front ends, and rearwardly thereto have grooved cut-out portions 14 and 20 defined therein, respectively, to facilitate grasping and clenching of clip 72. Clip 72 is stopped from further advancement at the exact alignment with grooves 14 and 20 between the jaws by clip guide 22. By providing this stopping and guiding function, clip guide 22 allows for proper and consistent grasping, alignment and clenching of clip 72 between upper and lower jaws 10 and 16. The stopping and guiding function of clip guide 22 can be contrasted with the prior art as seen by the prior art clip pliers in FIG. 2A where the prior art required an upper clip catch area 116 and lower clip catch area 118 formed as part of the jaws. The catch areas 116 and 118 stop the advancement of clip 72, as seen in FIG. 2C, between the upper jaw 106 and lower jaw 108 such that, as seen in FIG. 2D, when the upper jaw and lower jaw are moved together, the clip is clenched as seen by clenched clip 120 between the upper and lower jaws 106 and 108. There is great difficulty in accurately machining the upper clip-catch area 116 and lower clip catch area 118 so that they will stop the advancement of the clip exactly in alignment with the jaws. Further, as the clip gun experience wear, the upper catch area 116 and lower clip catch area 118 contact one another, as seen in FIG. 2B, before the clip is completely clenched thereby preventing the fill clenching of each clip. To avoid this problem, the clip gun of the present invention was developed, as seen in the right side view in FIG. 2F where much of the structure has been removed for clarity of illustration. There is no such catch area present within the upper jaw member 12 or lower jaw member 18 which are machined totally flat on their sides. The clip 72 is stopped from its advancing movement between the groove 14 in upper jaw member 12 and groove 20 in lower jaw member 18 by clip guide 22, as seen in FIG. 2E, which clip guide 22 catches the central portion of clip 72 within clip slot 35, as seen in FIG. 2G, and clip guide 22 holds the clip in position until the upper jaw member 12 and lower jaw member 18 are moved together by the action of the handles as described herein, grasping and then clenching the clip so as to form clenched clip 120 as seen in FIG. 2H. The clip guide 22 at that point has been passed by the front of the jaws advancing so that clip guide 22 is positioned rearwards thereof, as seen in FIG. 2F, and is pushed out of the way of the jaws because it can be moved backwards against clip guide spring 36. This new design allows for complete clenching of the clip where upper jaw member 12 and lower jaw member 18 do not contact one another, as seen in FIG. 2H, since there is no upper clip catch area or lower clip catch area to contact one another since they are no longer utilized in the new design of the clip gun of this invention. A clip guide opening 32 is defined in the first side of front handle member 44 at a central portion of guide opening 60. Clip guide 22 can move inward and outward within clip guide opening 32 as it is held movably in position by clip guide spring 36. The side of front handle member 44 also has a slot 26 defined therein, leaving a narrow member 40 between slot 26 and clip guide opening 32. Clip guide 22 has a notch 28 defined therein, leaving a narrow projection 30 on one side which projection 30 engages into slot 26, allowing clip guide 22 inward and outward movement but maintaining its alignment as projection 30 is restrained from any forward or rearward movement by the sides of slot 26. Clips 72 advance into clip receipt area 80 and are caught at their midpoint in clip slot 35 of clip guide 22.

The handle control system will now be described. As seen in FIG. 1, one end of spring member 52 fits inside slot 56 formed within rear handle 46. Spring member 52 then forms a loop 53 near second pivot 50 and then extends upward at its other end as front spring member 54 inside front handle member 44. Front spring member 54 lodged in front handle member 44 is continuous with, and made of, the same wire as that forming spring member 52. The placement of front spring member 54 against the inside of front handle member 44 creates the proper tension required for operation of the device, as described below. Further, by not having the loop of spring member 52 disposed around second pivot 50, as is done in the prior art, spring member 52 can be quickly and easily removed and replaced if necessary.

Figure 5:
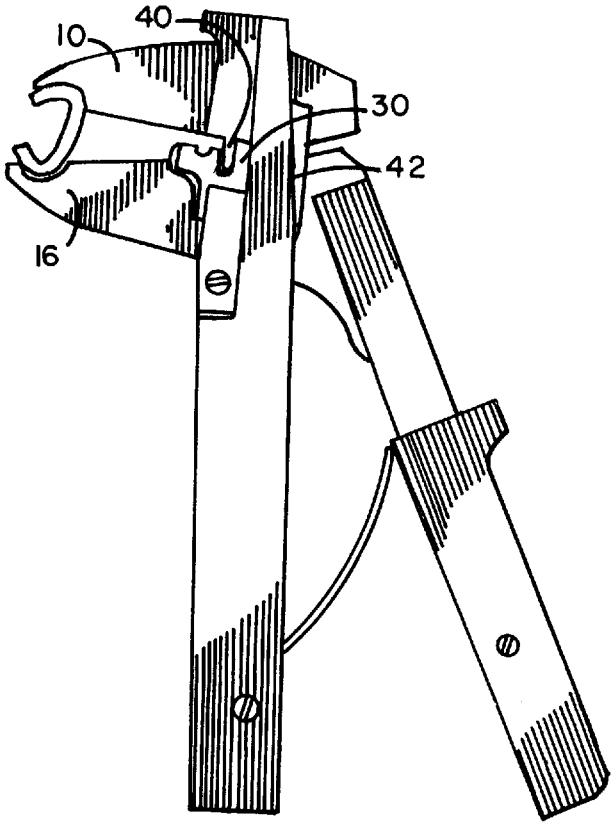
FIG. 5 illustrates a left side view of the device with the clip feed system omitted, showing the device in a first position with the jaws moved forward encircling a clip.
Figure 6:
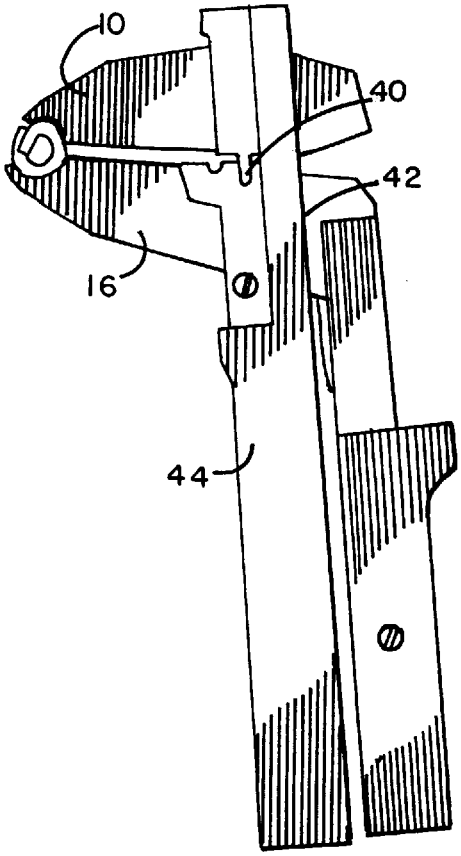
FIG. 6 illustrates a left side view of the device with the clip feed system omitted, showing the device in a second position with the jaws clenching a clip.

In the operation of this device, one can grasp rear handle 46 against the palm of one hand and place one's fingers around front handle member 44 while clip 72 is held in clip receipt area 80 at the end of clip slide 62 where it has been urged by the pressure of pusher member 64 pulled by extension spring 66. One then, in activation of the tool, moves the base of rear handle 46 forward which action raises lower jaw 16, grasping clip 72 in clip receipt area 80 between lower jaw 16 and upper jaw 10. As seen in FIG. 3, clip slot 35 of clip guide 22 receives clip 72 and stops the movement of the clip when it is aligned between the jaws. Clip guide 22 is flexibly mounted on front handle member 44 and is held by clip guide spring 36 to allow clip guide 22 to be pushed laterally out of the way to accommodate movement thereby of the jaws. One then continues this movement with the clip securely held by the jaws, pulling the front handle toward the rear handle. In this position, as seen in FIG. 5, clip 72 has been grasped and the jaws are starting to move forward with the lower jaw passing through guide opening 60, and the upper and lower jaws passing between clip slide 62 and clip guide 22. The jaws are then advanced forward by pulling the upper part of front handle member 44 rearward until the front of its hollow portion strikes lever bar 42 and the device is then manually maneuvered to position the clip around what is desired to be clipped together. One then squeezes the base of rear handle 46 inward against the pressure of spring member 52 which movement raises lower jaw 16, thereby clenching the clip, as seen in FIG. 6. When one then releases the device, the jaws are moved rearward by the action of the spring member and clip slide 62 again becomes aligned with clip receipt area 80 into which the next clip is advanced by the pressure of pusher member 64 while the jaws reopen to their original open positions.

While a series of clips can be placed on clip slide 62, most clips for this type of clip gun are sold in strips held together by a piece of tape. Clips used on the clip pliers of this invention can have perforations perpendicular to the row of clips between each adjacent clip. By starting the action of closing the jaws and the grasping by the jaws on the clip, the perforated tape is pulled apart at its perforations which tape held each clip to its adjacent clip and each clip is freed from the remaining clips for installation.

It should be noted that the device of this invention could be power-operated by non-manual means to close the handles of the device in a similar fashion to manual operation, such means being pneumatic closures, solenoid closures or equivalent means which are well known in the art.

Although the present invention has been described with reference to particular embodiments, it will be apparent to those skilled in the art that variations and modifications can be substituted therefor without departing from the principles and spirit of the invention.

I claim:

1. A device for the individual application of a plurality of hog-ring type clips, comprising:

an upper horizontally extending jaw having a front end and a rear end;

a lower horizontally extending jaw having a front end and a rear end;

a clip receipt area defined between the front ends of said upper jaw and said lower jaw;

a vertically disposed rear handle having a top and a bottom and having a slot defined therein, said rear handle attached at its top to the rear end of said lower jaw;

a lever member having a top and a bottom, the top of said lever member being attached to the rear end of said upper jaw;

a vertically disposed front handle having a front, a top, a bottom, a rear, a first side and a second side, said front handle having a guide opening defined at its front top through which guide opening said upper and lower jaws can pass, said front handle having a rearward facing front handle hollow area defined therein, said first side of said front handle having a clip guide opening defined therein adjacent to said guide opening, and said second side of said guide opening having a clip receipt opening defined therein;

a first pivot member pivotally attaching said lever member to said lower jaw at a point on said lever member lower than said lever member's point of attachment to said rear end of said upper jaw;

a second pivot member pivotally attaching the bottom of said lever member to the bottom of said front handle within said front handle hollow area;

means to urge said front handle away from said rear handle for said jaws to be in a clip receipt mode;

a clip slide attachment member affixed to the upper second side of said front handle;

a clip slide for retaining a plurality of clips thereon, said clip slide affixed to said clip slide attachment member, said clip slide having a first end and a second end, said first end disposed at approximately a 3 degree angle to said clip receipt area when said device is in its clip receipt mode and said second end receiving a plurality of clips which can be slid thereon to pass individually into said clip receipt area, said clip slide further including means to urge said plurality of clips forward, said device, when said front and rear handles are grasped by the user and manually moved together, being adapted to grasp a clip and move said jaws forward through said guide opening to a position beyond said guide opening where said clip can be positioned around the objects desired to be clipped together and by further manual pressure on said front and rear handles, the jaws clench said clip around the objects to be clipped together; and a clip guide disposed at an inward angle through said clip guide opening in said first side of said front handle, said clip guide having a clip slot defined therein to receive and align said clip between said upper and lower jaw.

2. The device of claim 1 further including a clip guide spring having a first and second end, said first end attached to said front handle and said second end urging said clip guide inward against an advancing clip yet allowing said clip guide to be moved laterally out of the way of said forwardly advancing jaws.

3. The device of claim 2 further including means to align said clip guide to prevent forward and rearward movement of said clip guide while allowing inward and outward movement of said clip guide.

4. The device of claim 3 wherein said upper and lower jaws are spaced apart a distance from one another and do not contact each other near their front ends when the jaws are fully clenched, thereby preventing only partial clenching of said clips and eliminating any need for adjustment of said jaws.

5. The device of claim 4 wherein said means to urge said plurality of clips toward said clip receipt area on said clip slide further includes:

an uncoilable coiled spring member having a first and second end;

a pusher member attached to said second end of said coiled spring member, said pusher member riding on said clip slide to advance said clips toward said clip receipt area;

a spring cover rotatably mounted on said front handle, said spring cover rotatable to an open mode and to a closed mode; and a spring retainer formed in a portion of said spring cover, said spring retainer for holding said coiled spring member when said spring cover is in its closed mode and for releasing said coiled spring member when said spring cover is rotated to its open mode.

* * * * *